United States Patent [19]

Palazzo

[11] 4,255,827

[45] Mar. 17, 1981

[54] REEFER SWEEPER

[76] Inventor: Salvator F. Palazzo, 154 Hickory Hill Rd., Philadelphia, Pa. 19154

[21] Appl. No.: 67,620

[22] Filed: Aug. 17, 1979

[51] Int. Cl.[3] ..... A46B 7/04

[52] U.S. Cl. ..... 15/160; 15/159 A; 15/176; 15/DIG. 5

[58] Field of Search ..... 15/106, 159 A, 160, 15/177, 166, 176, 172, 171, 201, 202, 194, DIG. 5, 159 R

[56] References Cited

U.S. PATENT DOCUMENTS

| | | | |
|---|---|---|---|
| 180,717 | 8/1876 | Isaacs | 15/160 |
| 1,490,078 | 4/1924 | Neff | 15/194 |
| 2,789,298 | 4/1957 | Peterson | 15/159 R X |
| 3,349,781 | 10/1967 | Poole et al. | 15/159 A |

*Primary Examiner*—Edward L. Roberts
*Attorney, Agent, or Firm*—Connolly and Hutz

[57] ABSTRACT

A reefer sweeper for cleaning a multi-level surface having alternating hills and valleys includes a plurality of major brush units alternately arranged with respect to a plurality of minor brush units with the major brush units having bristles which are longer than the bristles of the minor brush units so as to conform to the configuration of the surface being cleaned.

10 Claims, 12 Drawing Figures

Fig. 6.
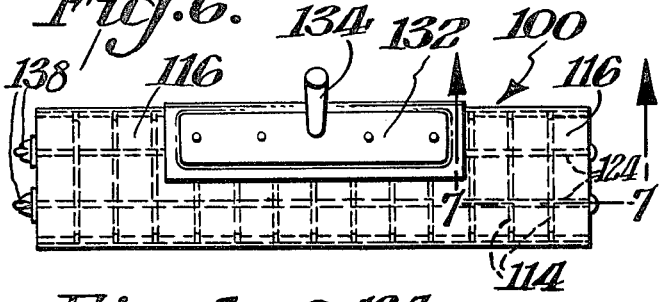
Fig. 4.
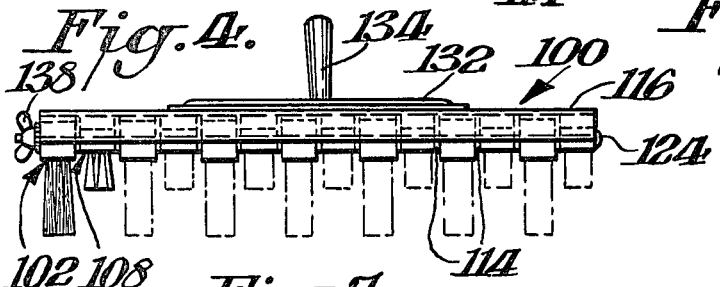
Fig. 5.
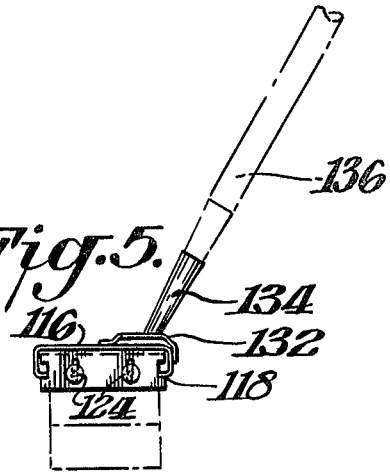
Fig. 7.
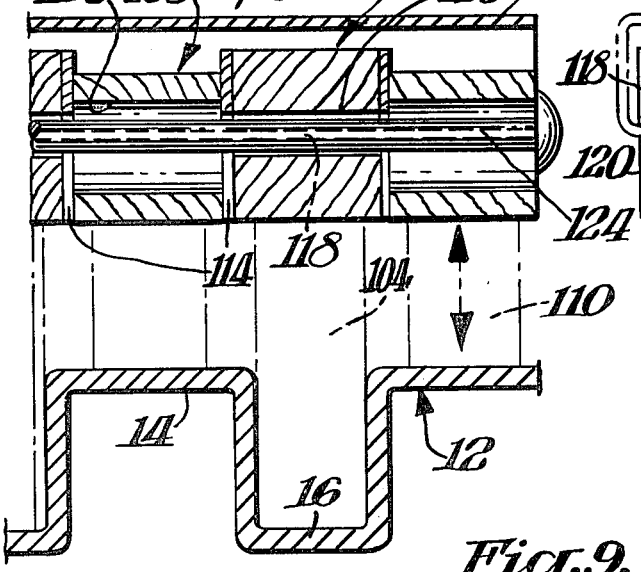
Fig. 8.
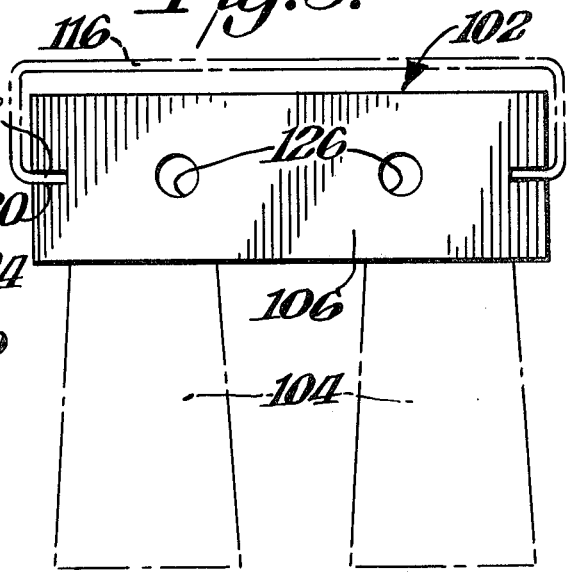
Fig. 9.
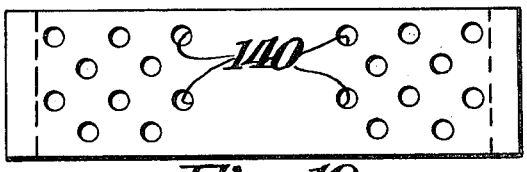
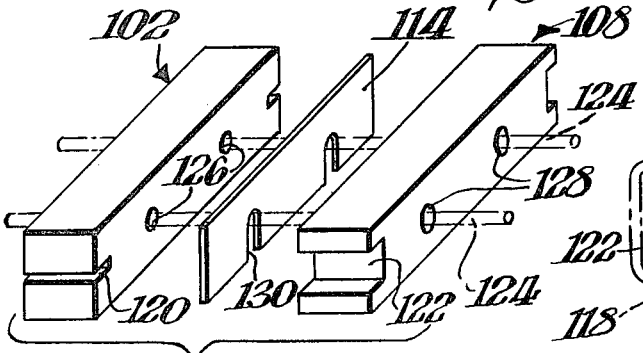
Fig. 11.
Fig. 10.
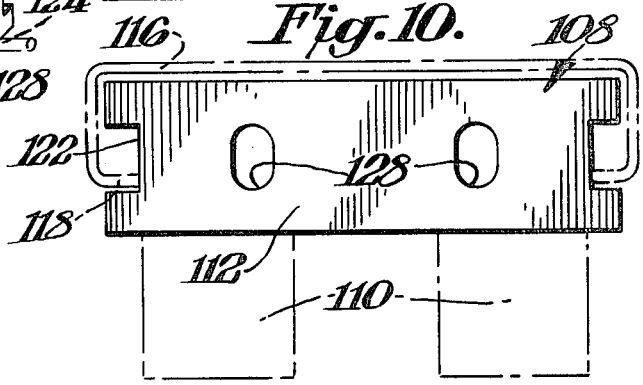

REEFER SWEEPER

BACKGROUND OF INVENTION

The present invention is directed to reefer sweepers and the like. The term reefer sweeper has general application to a device for cleaning, for example, grooved floors in trailers. In this respect such trailers have their floors grooved which provides hills and valleys so that air may circulate at the floor level whereby the heated and refrigerated products are protected when being shipped. During the course of using such trailers, the floors naturally become dirty. This is particularly important considering government regulations that require, for example, the interior of a trailer to be free of foreign odors, debris, etc.

The most common method of cleaning used for such a trailer is for the trucker to use a common household broom or garage type push broom. Because of the irregularities in the floor surface, however, these brooms are not effective. An alternative method of cleaning is to bring a trailer to a facility equipped with high pressure steam to thoroughly wash out the trailer. This latter alternative is quite costly and time consuming particularly when considering the travel and waiting time required during which the trailer can obviously not haul cargo. Accordingly, such a cleaning process is generally used only if the trailer is extremely dirty or has a particularly objectionable odor. A further disadvantage with such process results when the trucker is dispatched to a shipper immediately following a delivery to some consignee but cleaning or recleaning is a requirement before the load can be carried.

SUMMARY OF INVENTION

An object of this invention is to provide a broom which is particularly designed to function as a reefer sweeper.

A further object of this invention is to provide such a reefer sweeper which can be manufactured at low cost while effectively cleaning a trailer floor particularly in comparison with cost and inconvenience attendant with conventional systems utilizing high pressure steam or water.

A still further object of this invention is to provide such a reefer sweeper which is adapted to function effectively with different types of contours encountered by different manufactured trailers.

In accordance with this invention, the reefer sweeper includes a plurality of major brush units having relatively stiff bristles extending from a base with the major brush units alternately arranged with respect to similar minor brush units but with the bristles in the major brush units being longer than the bristles in the minor brush units so as to form a composite assembly wherein the profile of the brush units generally conforms to the profile of the grooved trailer floor.

In accordance with one embodiment of this invention, the various brush units are secured together in a non-adjustable manner with the dimensions thereof selected to conform to a particular make trailer floor. Various sets of such reefer sweepers could be provided in accordance with the different make trailers.

In an alternative form of this invention, the minor brush units are vertically adjustable so as to vary the difference in effective length of the bristles and thereby permit the profile of the reefer sweeper would be adjusted for different types of trailer floors. In this embodiment of the invention, detachable spacers may be provided to allow adjustment of the brush profile in its horizontal direction thus further lending itself to profile variability whereby different floor surfaces may be accommodated.

THE DRAWINGS

FIG. 4 is an elevation view of a modified form of a reefer sweeper;

FIG. 5 is an end elevation view of the reefer sweeper shown in FIG. 4;

FIG. 6 is a top plan view of the reefer sweeper shown in FIGS. 4–5;

FIG. 7 is a cross-sectional view taken through FIG. 6 along the line 7—7;

FIG. 8 is an end elevation view of a major brush unit utilized in the reefer sweeper shown in FIGS. 4–7;

FIG. 9 is a bottom plan view of the reefer sweeper shown in FIG. 8;

FIG. 10 is an end elevation view of a minor brush unit utilized in the reefer sweeper shown in FIGS. 4–7;

FIG. 11 is an assembly view showing a minor brush unit and a major brush unit with a spacer therebetween.

DETAILED DESCRIPTION

Figure 1:
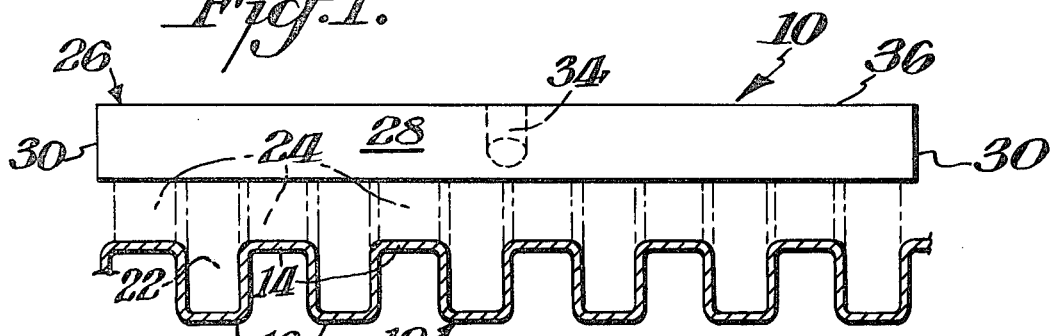
FIG. 1 is an elevation view of a reefer sweeper in accordance with one embodiment of this invention.

It is noted that when referring to various embodiments, such as FIGS. 1–3 or FIGS. 4–11, certain reference numerals may be shown in some figures but not necessarily in all figures of that embodiment, to avoid confusion by too many reference numerals in each figure.

Figure 2:
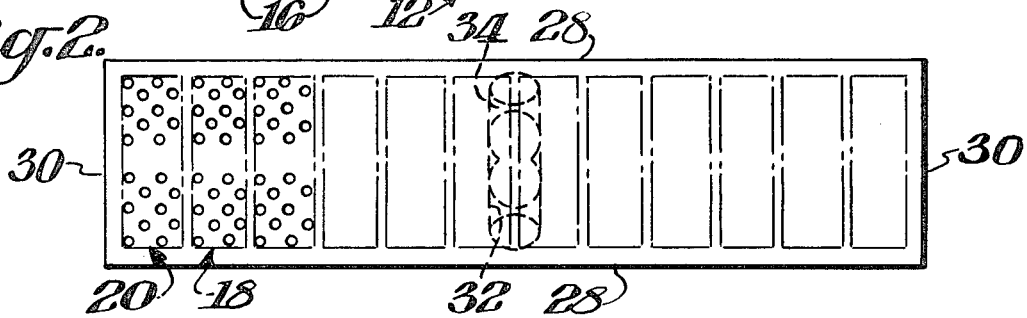
FIG. 2 is a bottom plan view of the reefer sweeper shown in FIG. 1.
Figure 3:
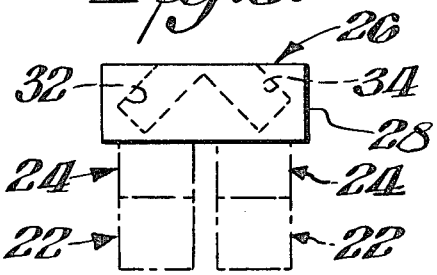
FIG. 3 is an end elevation view of the reefer sweeper shown in FIGS. 1–2.

FIGS. 1–3 show a reefer sweeper 10 in accordance with one embodiment of this invention. As indicated, reefer sweeper 10 is used for cleaning a grooved or multi-level trailer floor surface 12 having alternate hills 14 and valleys 16.

In general reefer sweeper 10 includes a plurality of major brush units 18 and a plurality of minor brush units 20 alternately arranged with respect to each other whereby each major brush unit 18 is located next to a minor brush unit 20 in side-by-side fashion. Each major brush unit comprises a base member having a plurality of relatively stiff bristles 22 extended downwardly therefrom while each minor brush unit 20 similarly comprises a base member having a plurality of bristles 24 extended downwardly therefrom. In the embodiment of FIGS. 1–3, a common base member 26 is used for all of the major and minor brush units. The composite assembly includes a front face 28 formed by the front faces of each of the units 22, 24.

As best shown in FIG. 3, a pair of inclined handle receiving openings 32, 34 are provided in the top wall 36 of base member 26 for removably receiving the handle as conventionally done with garage type push brooms. Thus when the handle (not shown) is mounted in a respective hole 32 or 34, the composite assembly would be moved in a direction perpendicular to its front face. As later described, the lengths of the bristles 22 and of the bristles 24 are so selected that when the composite assembly or reefer sweeper is moved in the aforesaid direction, the bristle profile conforms to the configuration of the hills and valleys 14, 16 of the trailer floor.

Trailers having grooved floors are made by various manufacturers such as Freuhauf, Strick and Gindy. Unfortunately, the different manufacturers do not use a standardized configuration or profile for the grooved trailer floors. Accordingly, in the practice of the invention, as illustrated in FIGS. 1–3, the dimensions for the reefer sweeper 10 would be so selected that a particular reefer sweeper would conform to the profile of a particular manufactured trailer floor and different such reefer sweepers would thus be made to accommodate different manufacturer's trailers. To determine the proper form of sweeper with respect to the setting of brush units 22, 24, measurements are made of the centerlines of each longitudinal hill and valley of the trailer floor rack and of the top surface of each hill, as well as the bottom surface of each valley. Thereafter the measurement figures are transposed to common base 26 to accurately set the bristles for the major units to occupy the valleys and the minor units to press on the hills. While the practice of the embodiment of this invention necessitates a plurality of different reefer sweepers to be made, it does have the advantage of simplicity of construction which in turn lends itself to low cost and ease of utilization.

FIGS. 4–11 show an alternate practice of this invention wherein a single adjustable reefer sweeper 100 is provided which is adaptable to be used with varying types of grooved floor profiles. In general, the embodiment of FIGS. 4–11 includes a plurality of major brush units 102 comprising base members 106 having bristles 104 extending downwardly therefrom and a plurality of alternately arranged minor brush units 108 comprising base members 112 having bristles 110 extending downwardly therefrom. In addition, a spacer 114 (best illustrated in FIG. 11) is provided between each major and minor brush unit as later described. The various components are secured together in side-by-side fashion to form a composite assembly which is longer in its front face than it is wide similar to the embodiment of FIGS. 1–3. Again, similar to the embodiment of FIGS. 1–3, the bristle profile is so selected to conform to the hills and valleys 14, 16 of the trailer floor 12. Since this embodiment, however, is intended to conform to various types of configurations or floor profiles, it is necessary that a degree of adjustment be provided for varying the effective relative length between the bristles 104 of the major brush units and the bristles 110 of the minor brush units. This degree of adjustment is achieved by selectively permitting vertical movement of the minor brush units with respect to the major brush units as later described.

Since, unlike the embodiment of FIGS. 1–3, the reefer sweeper 100 does not include a common base member, it is necessary that the individual base members in the individual brush units be secured together. This is accomplished by providing a channel shaped top plate 116 which has inwardly extended flanges 118. Each base member 106, 112 in turn is provided with peripheral grooves or cutouts 120, 122 to receive flanges 118. The individual brush units 102 and 108 and the spacers 114 are further secured together by elongated fasteners 124 which extend through aligned holes in the various elements. As best shown in FIGS. 8, 10 and 11, holes 126 in major brush unit base member 106 are generally circular in cross section approximately corresponding to the diameter of fasteners 124. Holes 128, however, in base members 112 of the minor brush units 108 are elongated as shown in FIG. 10. Similarly, holes 130 in spacers 114 are elongated slots which extend from the lower edge of each spacer 114.

As shown in FIGS. 4–6 top plate 116 additionally has secured thereto a smaller plate 132 with an upwardly and inclined handle receiving socket 134 so that a handle may be detachably secured therein in a conventional manner.

To assemble the various components of reefer sweeper 100, the major and minor brush units 102, 108 are alternately arranged with respect to each other. Fasteners 124 are inserted through the generally aligned holes 126, 128 until the fasteners 124 extend completely through the units. The thus loosely assembled composite may be placed directly on the surface 12 of the trailer floor with the minor brush unit bristles resting on the hills 14 and the major brush unit bristles resting in the valleys 16. If a spacing is required between the units, a spacer or insert 114 could be dropped over fasteners 124, and depending on the amount of space required, the appropriate number of inserts would be so assembled. By thus resting with brush units on the trailer floor, the minor brush units are free to move vertically because of the elongated holes 128 so as to automatically assume the profile of the grooved trailer floor. Suitable locking means such as nuts 138 or threaded washers are then securely attached to the threaded ends of rods or fasteners 124 so as to clamp the components securely in place and thus lock them in the desired profile in accordance with the particular profile of the trailer floor. Channel shaped top plate 116 is then slid over the composite with the flanges 118 thereof fitting in grooves 120, 122. Because grooves 122 are oversized, flanges 118 are accommodated despite any vertical movement of minor brush units 108 during their assembly. If desired, top plate 116 may also include locking elements (not shown) to assure that the top plate 116 remains fastened to the brush assembly. As illustrated clearance is provided between top plate 116 and the brush units to permit vertical movement of the brush units and to accommodate the fasteners such as screws for plate 132. If desired, one end of channel shaped top plate 116 may be closed by an end wall against which the adjacent brush unit would abut. Handle 136 is then secured to top plate 116 in a conventional manner.

The basic concepts of this invention may be practiced in various manners. FIGS. 8 10, for example, illustrate a particularly advantageous arrangement for the bristles 104, 110 of the brush units. As illustrated therein, each brush unit includes two space sets of bristles 104, 104 or 110, 110. FIG. 9 shows the arrangement of the individual clusters of bristles in each set. As indicated therein, the clusters are arranged in staggered rows so as to maximize the bristle area while at the same time maximizing the distance between the holes 140 in the base member from which the bristles extend. The arrangement of the clusters of bristles in spaced holes 140 and the provision of sets of such bristles with a gap therebetween is particularly advantageous since it facilitates the ability of the bristles to bend to conform to the grooved floor during the sweeping action while pressure is being exerted on the broom or sweeper 10 or 100 and thus assures maximum efficiency in cleaning the grooved floor.

The invention may be practiced using various materials and various dimensions. For example, in a preferred form of the invention, the bristles 22, 104 for the major brush units are made of straight Tynex nylon 0.022 inch in diameter and 2⅛ inches long while the minor brush unit bristles 24 or 110 are of crimped Tynex nylon 0.17 inch in diameter and one inch long. Generally, the major brush unit bristles 22, 104 are about twice as long ±⅛ inch as the minor brush unit bristles 24, 110. Other dimensions and materials, of course, may be used. Alternately either the long and/or short bristles may be straight and/or crimped.

The base members for the brush units may be of any suitable material such as plastic or wood and may have various dimensions. In the embodiment illustrated in FIG. 1 which is of fixed design, the dimensions would be dictated by the trailer body for which it is adapted. Generally, however, the common base member 26 would be about 42 cm. at its front face with the side 9 cm. wide and a height of 3 cm. Each minor brush unit would have a front face of 2.8 cm. wide while the font faces for each major brush unit would be 2.8 cm. wide. The dimensions of the embodiment illustrated in FIGS. 4–11 may generally correspond as previously indicated. In selecting the dimensions, consideration must be given to the fact that the embodiment of FIGS. 4–11 is intended to accommodate different dimensioned floors. Accordingly, in the preferred practice of the invention, the base member 106 of each major brush unit has a front face 1⅛ inches wide with its side 3½ inches wide and a height of 1⅛ inches. As previously noted, the bristle length extending beyond base member 106 is 2⅛ inches. The minor brush units 108 would be similarly dimensioned except that the height of each base member 112 is only one inch and its elongated holes 128 is only ⅝ inch by ¼ inch whereas holes 126 are ¼ inch in diameter. The sets of holes would be located inwardly one inch from the ends thereof and along the centerline of each major and minor base member. Shorter bristles 110 extend beyond base member 112 by a distance of one inch. Spacers 114 are dimensioned to be compatible with the dimensions of major brush units 102 and minor brush units 108. Similarly, the thicknesses of the spacers may vary, although 1/16 inch is preferred.

Although the embodiment of FIGS. 4–11 illustrate top plate 116 to be, for example, of channel shaped sheet metal, other variations are possible. For example, the top member may be made of wood stock having a threaded hole to accommodate a broom handle and may have wood or metal face plates.

Similarly, the drawings illustrate the elongated holes and oversize grooves to be in the minor brush units; if desired, however, they may be instead in the major brush units.

Figure 12:
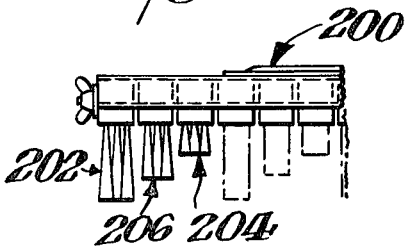
FIG. 12 is an elevation view of a reefer sweeper in accordance with a further embodiment of this invention.

It is to be understood that as used herein, the term "reefer" is not intended to limit the practice of this invention to a double level grooved trailer floor, but the invention may be practiced with other such irregular surfaces such as found in railway cars or grated racks set in refrigerated box units. The invention, in fact, may even be practiced where the repeated multi-level pattern is of more than two levels. Thus, for example, FIG. 12 illustrates a sweeper 200 having major brush units 202, minor brush units 204 and intermediate brush units 206 to accommodate three leveled surfaces. Obviously, the invention may also be varied within the concept thereof to accommodate an even greater number of levels.

Another variation of the invention would be to practice the embodiment of FIGS. 1–3 relating to the fixed sweeper along the lines of the adjustable sweeper by having separate brush units (rather than bristles from a common base) secured together. This would be similar to the embodiment of FIGS. 4–11 except that there would be no elongated holes in any brush unit.

What is claimed is:

1. A reefer sweeper or the like for cleaning a multi-level surface having alternating hills and valleys comprising a plurality of major brush units, a plurality of minor brush units, said major brush units and said minor brush units being alternately arranged whereby each major brush unit is located next to a minor brush unit in a side-by-side fashion, each major brush unit comprising a base member having a plurality of relatively stiff bristles extending downwardly therefrom and its sides being substantially longer than its front face, each minor brush unit comprising a base member having a plurality of relatively stiff bristles extending downwardly therefrom and its sides being substantially longer than its front face, fastening means securing said major brush units and said minor brush units together in said side-by-side fashion to form a composite assembly, said composite assembly having a front face formed by said front faces of said units and having a length corresponding to the length of said sides of said units, said composite assembly front face being substantially longer than said sides of said units, a handle secured to said composite assembly for moving said composite assembly in a direction perpendicular to its said front face, and the length of said major brush units bristles being longer than the length of said minor brush units whereby said bristle lengths may be selected to conform to the configuration of the hills and valleys of the surface being cleaned.

2. The sweeper of claim 1 wherein said base members of said major brush units and of said minor brush units are integral to thereby comprise said fastening means.

3. The sweeper of claim 1 wherein aligned holes extend through said base members of said minor brush units and of said major brush units, said fastening means extending through said holes, locking means on said fastening means for securing said brush units together, and all of said holes in said minor brush units or in said major brush units being elongated to permit relative vertical adjustment of said minor brush units with respect to said major brush units.

4. The sweeper of claim 3 including spacer inserts removably positioned between adjacent brush units to vary the effective width thereof.

5. The sweeper of claim 4 including a channel shaped top plate having inturned flanges, grooves in the front faces of said brush units for receiving said flanges when said plate is slid over said brush units, and said grooves in said brush units being correspondingly elongated.

6. The sweeper of claim 1 wherein said bristles of said major brush units extend downwardly from its base members a distance about twice as long as said bristles of said minor brush units.

7. The sweeper of claim 6 wherein said bristles in each of said brush units is formed is two spaced sets, and each set of bristles comprising individual rows of alternate staggered clusters of bristles.

8. The sweeper of claim 7 wherein said bristles of said major brush units are straight, and said bristles of said minor brush units are crimped.

9. The sweeper of claim 1 including a plurality of at least one intermediate brush units for conforming to a multi-level surface of at least three levels.

10. The sweeper of claim 1 wherein said bristles in each of said brush units is formed is two spaced sets, and each set of bristles comprising individual rows of alternate staggered clusters of bristles.

* * * * *